US008193495B2

(12) United States Patent
Parks et al.

(10) Patent No.: US 8,193,495 B2
(45) Date of Patent: Jun. 5, 2012

(54) TOOL FOR DICOROTRON WIRE ASSEMBLY REMOVAL AND STORAGE

(75) Inventors: Bruce J. Parks, Bloomfield, NY (US); Jamie S. Clayfield, Rochester, NY (US); Douglas S Smith, Rochester, NY (US); James D. Walsh, Rochester, NY (US); Eliud Robles Flores, Webster, NY (US); Gerald F. Daloia, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 836 days.

(21) Appl. No.: 12/200,136

(22) Filed: Aug. 28, 2008

(65) Prior Publication Data

US 2008/0307638 A1 Dec. 18, 2008

Related U.S. Application Data

(62) Division of application No. 11/235,936, filed on Sep. 27, 2005, now Pat. No. 7,432,504.

(51) Int. Cl.
*H01T 19/00* (2006.01)

(52) U.S. Cl. ..... 250/324; 250/325; 250/326; 361/230; 29/748; 29/762

(58) Field of Classification Search ..... 29/745–748, 29/729, 739, 884–876; 250/324–326; 361/226–230; 429/557, 939

See application file for complete search history.

(56) References Cited

U.S. PATENT DOCUMENTS

| | | | | |
|---|---|---|---|---|
| 5,449,906 | A | 9/1995 | Osbourne | |
| 6,787,774 | B1 * | 9/2004 | Rumpel et al. | 250/325 |
| 7,208,732 | B2 * | 4/2007 | Clayfield et al. | 250/324 |
| 7,342,227 | B1 | 3/2008 | Blair | |
| 7,432,504 | B2 * | 10/2008 | Parks et al. | 250/324 |

OTHER PUBLICATIONS

See U.S. Appl. No. 11/235,935 and U.S. Appl. No. 11/235,937 for Related Unpublished Applications.

* cited by examiner

*Primary Examiner* — Minh Trinh
(74) *Attorney, Agent, or Firm* — Ronald E. Prass, Jr.; Prass LLP

(57) ABSTRACT

A system and apparatus that removes and collects non-functional wire assemblies from dicorotron units is described. It has a removal tool with flexible levers mounted on the top of a storage box. The removal tool has an open top and bottom, the open bottom is aligned with an opening in the top of the box to permit a dislodged anchor and wire assembly to fall therethrough.

12 Claims, 5 Drawing Sheets

TOOL FOR DICOROTRON WIRE ASSEMBLY REMOVAL AND STORAGE

This application Ser. No. 12/200,136 is a divisional application of pending parent application Ser. No. 11/235,936 filed Sep. 27, 2005.

CROSS REFERENCE

Illustrated and disclosed in applications, all owned by the present assignee, (Now U.S. Pat. No. 7,420,169 to Parks et al; "DICOROTRON WIRE ASSEMBLY REMOVAL-INSERTION TOOL") and (Now U.S. Pat. No. 7,208,732 to Clayfield et al; "STRUCTURE FOR ATTACHING WIRE ASSEMBLY TO A DICOR HOUSING"), are applications relating to dicorotrons used in an electrostatic process. These two applications and the present application are filed concurrently herewith.

In (Now U.S. Pat. No. 7,420,169 to Parks et al; "DICOROTRON WIRE ASSEMBLY REMOVAL-INSERTION TOOL"), concurrently filed herewith, a dicorotron wire assembly and removal tool is disclosed and claimed. In (Now U.S. Pat. No. 7,420,169 to Parks et al; "DICOROTRON WIRE ASSEMBLY REMOVAL-INSERTION TOOL"), a tool is used to both remove and insert a wire assembly from and into a U-shaped dicorotron unit. When an empty tool removes a faulty wire assembly from the dicorotron unit, remaining is an empty dicorotron unit devoid of a wire assembly. This empty dicorotron unit is then supplied a new wire assembly by a duplicate tool loaded with this new wire assembly. The loaded tool, in a deposit step, deposits a wire assembly in the dicorotron now leaving an empty tool. This empty tool is then used in a removal step to remove a faulty wire assembly from a second dicorotron unit, etc.

In (Now U.S. Pat. No. 7,208,732 to Clayfield et al; "STRUCTURE FOR ATTACHING WIRE ASSEMBLY TO A DICOR HOUSING"), a new structure for holding a wire assembly in place is disclosed and claimed. Since it has become necessary to remove faulty wire assemblies from a dicorotron unit, any significant provision that simplifies this removal procedure is important. In this (Now U.S. Pat. No. 7,208,732 to Clayfield et al; "STRUCTURE FOR ATTACHING WIRE ASSEMBLY TO A DICOR HOUSING") application, a wire assembly(s) is snapped into mating plastic inserts which in turn attaches to the dicorotron housing. This allows for easier installation of new wire assemblies and for easier removal of old wire assemblies using various removal methods and apparatuses. The presently disclosed embodiments are directed to corona charging in an electrostatic printing process and, more specifically, to apparatus and systems for removal of faulty wire assemblies in dicorotrons.

BACKGROUND

In electrostatographic reproduction, a light image of an original to be printed is typically recorded in the form of a latent electrostatic image upon a photosensitive member with a subsequent rendering of the latent image visible by the application of electroscopic marking particles, commonly referred to as toner. The visual toner image can be either fixed directly upon the photosensitive member or transferred from the member to another support medium such as a sheet of plain paper. To render this toner image permanent, the image must be "fixed" or "fused" to the paper, generally by the application of heat and pressure.

With the advent of high speed xerography reproduction machines wherein printers can produce at a rate in excess of three thousand copies per hour, the need for corotrons or dicorotrons at many processing stations is needed in a reliable and dependable manner in order to utilize the full capabilities of the reproduction machine. These corotron systems must operate flawlessly to virtually eliminate risk and generate minimum machine shutdowns due to corotron malfunctions.

Generally, in electrostatographic or electrostatic printing processes, a number of corotrons or dicorotrons are used at various stations around the photoreceptor. For example, the dicorotrons are used at the station that places a uniform charge on the photoreceptor, at a transfer station, at a cleaning station, etc. In today's high speed printers, it is important that all corotrons (or dicorotrons) are in perfect working order since one corotron malfunction can easily render the entire printing process useless. Some high speed printers including color printers use several dicorotron units. In one embodiment, as many as sixteen corotron or dicorotron units are used. So, maintaining each corotron or dicorotron unit in perfect working order is essential to the proper functioning of these complex fast color printers. It is common to use one or several corona-generating device(s) ("corotron" or "dicorotron") for depositing the electrostatic at the above-noted stations. Generally, the structure of a dicorotron uses a thin, glass-coated wire mounted between two insulating anchors or end blocks called "anchors" which support the wire in a highly tensioned manner in a singular plane. In this disclosure, the term "anchors" includes insulator, end blocks, insulating anchors, etc. These anchors are installed between flexible holders or clamps or anchor inserts that maintain the anchors in place. These anchor inserts are fixed at two opposite ends of a U-shaped dicorotron "housing" or "shells" or "shield". The wire or corona-generating electrode is typically a highly conductive elongated wire situated in close proximity to the photoconductive surface to be charged. Often, the corona discharge electrode is coated with a dielectric material such as glass, for glass coating improves charging uniformity throughout the electrode's life. Since the wire electrode is comprised of a thin outer glass brittle coating, it may be easily damaged. Some handling or cleaning of this electrode often results in fracture of the glass coating which could cut or injure the user. While cleaning sometimes corrects problems in this corona electrode, it is sometimes necessary to replace the wire due to degradation in the corona performance or even in breakage of the electrode which could occur during the cleaning.

Manual handling of the glass-coated wire is not recommended nor is the use of prying tools such as screw drivers or rigid prying objects. Extreme care needs to be observed in changing the corona electrodes or wires. As above noted, because of the large number of dicorotrons or wires needed in some copiers, malfunctioning of these wires presents a formidable problem in today's complex copiers.

Another important consideration is the high costs of dicorotron assemblies. The most expensive major component in the dicorotron assembly is the housing or U-shaped shield which houses the wire assembly and the wire anchors. The least expensive major component in the dicorotron assembly is the wire assembly. It makes sense, therefore, for the faulty wire assembly to be removed and replaced rather than the expensive entire dicorotron assembly made up of the wire assembly and U-shaped housing.

There are some systems used to remove and replace wire electrodes from the U-shaped housing such as the method disclosed in U.S. Pat. No. 5,449,906 (Osbourne). In this prior art system, the U-shaped housing has apertures on its end portions adjacent to the electrode anchors or insulators. A prying tool is then inserted into this aperture to pry or dislodge the two end insulators from their original position thereby removing the two insulators and the attached wire electrode. A tool for replacing the removed wire electron in Osbourne's process includes a plurality of replacement electrodes mounted on a rigid support frame. Replacement is accomplished by pressing this support frame containing a plurality of corona-generating wire assemblies against the empty U-shaped housing (where old wire has been removed) and thereby replacing the removed wire electrode with a new wire electrode. This prior art process requires prying or dislodging the old wire through an aperture and replacing the old wire with a mounting system where a plurality of corona-generating electrode assemblies are removably mounted in a configuration matching that of the original configuration.

SUMMARY

The presently disclosed embodiments provide an improvement in the system to remove (and later install) wire electrodes used in an electrostatic process. In the present device and system, a method is provided for safe removal of the dicorotron wire assembly at the customer site by tech-reps or customers. Faulty wire assemblies in this embodiment are removed by placing a dicorotron unit containing a faulty wire assembly open face down into a removal tool. The removal process is completed by pressing two release levers in the removal tool to dislodge the two anchors with the attached wire electrode and receive these removed wire assemblies into a storage box. This procedure keeps the tech-rep and/or customer safe from the glass-coated wire since the user never touches the old used-up wire assembly. A removal tool is operatively located fixed on top of a storage box and a slot extending substantially the length of the removal tool is located immediately below the removal tool. When the old wire assembly is dislodged from the old U-shaped housing, it falls through the slot into the storage box. The removal tool has two flexible levers located at each of its ends, each lever has projecting from it and in alignment with both a slot opening in the removal tool and an aperture in the old U-shaped housing. The user places this U-shaped housing with the wire assembly upside down over the top of the dicorotron removal tool and pushes downward into nesting features where the U-shaped assembly nests open-face down into the removal tool. The apertures in the U-shaped assembly align with a slot opening in the removal tool. The flexible push levers have pins extending therefrom and also in alignment with the slot openings and apertures. When the flexible levers are pushed, the pins or projections attached to the inside of the levers travel through the slot (in the tool) and the apertures (in the U-shaped assembly) to contact the grippers to unseat the anchors, releasing the anchors to thereby dislodge the anchors from their original position. The two anchors and the wire electrode attached to these anchors with the grippers then are released from the U-shaped assembly and fall through the open bottom of the tool and a slot or opening in the storage box. When the dicorotron wire assembly removal box is full, the contents are emptied into a disposal bag for permanent disposal.

This removal operation requires no prying tool to reach into the U-shaped assembly to dislodge the anchor-wire structure. The flexible levers with the projecting pins easily protrude through the slots and apertures, and when pushed in, cause the release of the anchors and thereby the old attached wire electrode. The removal tool is usually a molded plastic structure having these release levers molded in as one piece. By locating the removal tool above an opening in the storage box, this causes the dislodged anchor-wire assembly to freely fall through the opening into the storage box. The pins, in effect, push into the anchor seating and dislodge or force the anchors out from the housing assembly releasing the entire anchor-wire electrode assembly.

The new replacement wire electrodes and anchors are inserted or installed into the emptied original U-shaped housing by any suitable method. In one system, installation of the new wire assemblies is accomplished by placing a new wire insertion tool over the empty old dicorotron U-shaped housing and pressing the wire assembly in place. In the wire installation, a wire insertion tool is shipped with a new wire assembly inside of it. The new tool/wire assembly is then positioned over the empty old dicorotron shell (U-shaped housing) and snapped in place. Then the tool is pulled upwards while pushing the thumbs through openings on top of the tool to release a new wire assembly into the empty old dicorotron U-shaped housing. However, once the removal system of this invention is used, any suitable wire electrode replacement method may be used. However, any suitable method may be used to insert or deposit a new wire assembly in the emptied old dicorotron unit.

In summary, and as noted above, the present embodiments involve a wire assembly removal system convenient for use by a tech-rep or a customer. The user places a dicorotron U-shaped housing (containing the faulty wire electrode) upside down over the top of the dicorotron wire removal box of an embodiment of this invention and pushes downward into the nesting features. This nesting feature involves the U-shaped housing fitting inside the removal tool. By pushing in two levers on the front of the dicorotron wire assembly box, the old wire assembly inside of the U-shaped housing is released and captured inside the removal box. The U-shaped housing is contacted with the removal tool where the open face of the U faces the top of the removal tool.

In summary, these embodiments use a device to remove old, non-usable wire assemblies from a dicorotron unit. This device comprises in an operative relationship a collection box and a removal tool. The removal tool is located and fixed on a top portion of said box and positioned above an opening in the box. The removal tool has a configuration conforming generally to a shape of said dicorotron unit but having dimensions at least larger than corresponding dimensions of said dicorotron unit. This is to allow for the dicorotron unit to fit and nest therein. The removal tool has flexible levers on each of its end portions adapted to remove and dislodge said wire assembly from said dicorotron unit. In this device, the removal tool has an open top section enabled to receive and contain dicorotron unit during a wire assembly removal process.

The device has an opening in the box with dimensions at least large enough to permit a removed wire assembly to pass therethrough. In this device the levers have projections that are enabled to pass through both a slot in a side portion of the removal tool and an aperture in the dicorotron unit. The aperture(s) are adjacent to the anchors that hold the wire assembly in place in the dicorotron unit.

As later shown in the drawings, the removal tool has an open top portion and an open bottom portion. The open top portion is adapted to receive and hold the dicorotron unit during the wire removal operation and the open bottom portion is adapted to allow the wire assembly to pass therethrough to the opening in the box.

This device as noted is used to remove a used wire assembly from a dicorotron unit. This device comprises in an operative relationship a storage box and a removal tool. The removal tool is located above an opening in the box and has a configuration that will permit the dicorotron unit to fit and nest therein. The removal tool has flexible levers and slots on its end portions that align with apertures in the dicorotron unit. These slots are in alignment with projections in the levers and the apertures are in alignment with anchors holding the wire assembly in place in the dicorotron unit. These flexible levers are adapted when pushed to move the projections through the slots and the apertures to contact and dislodge the anchors thereby releasing the wire assembly from the dicorotron unit.

This device to remove a previously used wire assembly from a dicorotron unit in one embodiment comprises in operative cooperation a storage box and a removal tool. The storage box has on its top portion an opening large enough to permit a released wire assembly to pass therethrough. The removal tool is located and fixed immediately above the opening. The removal tool has a shape with side sections, end sections, a top portion and a bottom portion. The top portion and the bottom portion are open, at least one of said side sections has flexible levers with adjacent slots. The levers have projections that will pass through the slots when the levers are pushed or activated. These slots are in operative alignment with apertures in the dicorotron unit. The apertures are adjacent to the anchors in the dicorotron unit. These anchors are removably holding the wire assembly in place. The projections are enabled to contact and dislodge the anchors during a wire assembly removal operation. The removal tool and the storage box are reusable up to a point where the storage box has reached its capacity to accept and hold the removed wire assemblies.

DETAILED DISCUSSION OF DRAWINGS AND PREFERRED EMBODIMENTS

Figure 1:
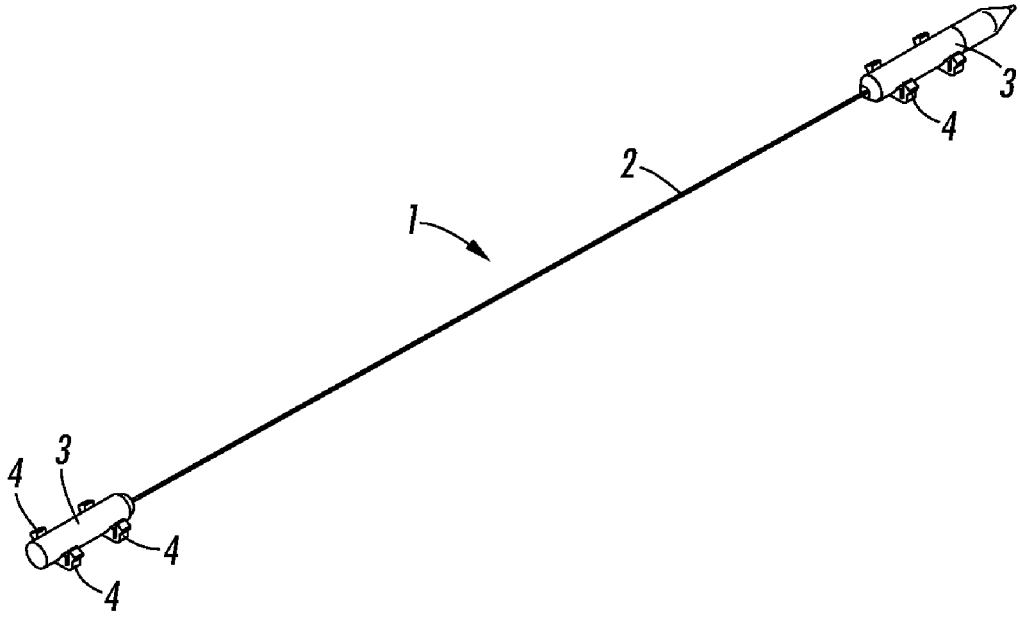
FIG. 1 illustrates in an embodiment, a typical wire assembly as it is removed from a dicorotron unit and dicorotron housing.

In FIG. 1, a typical wire assembly 1 is illustrated where the wire assembly 1 comprises a wire electrode 2 tautly held in place by anchors 3. The anchors 3 are held in position by fixed grippers 4. The wire assembly, therefore, comprises a wire electrode 2, anchors 3 and grippers 4.

Figure 2A:
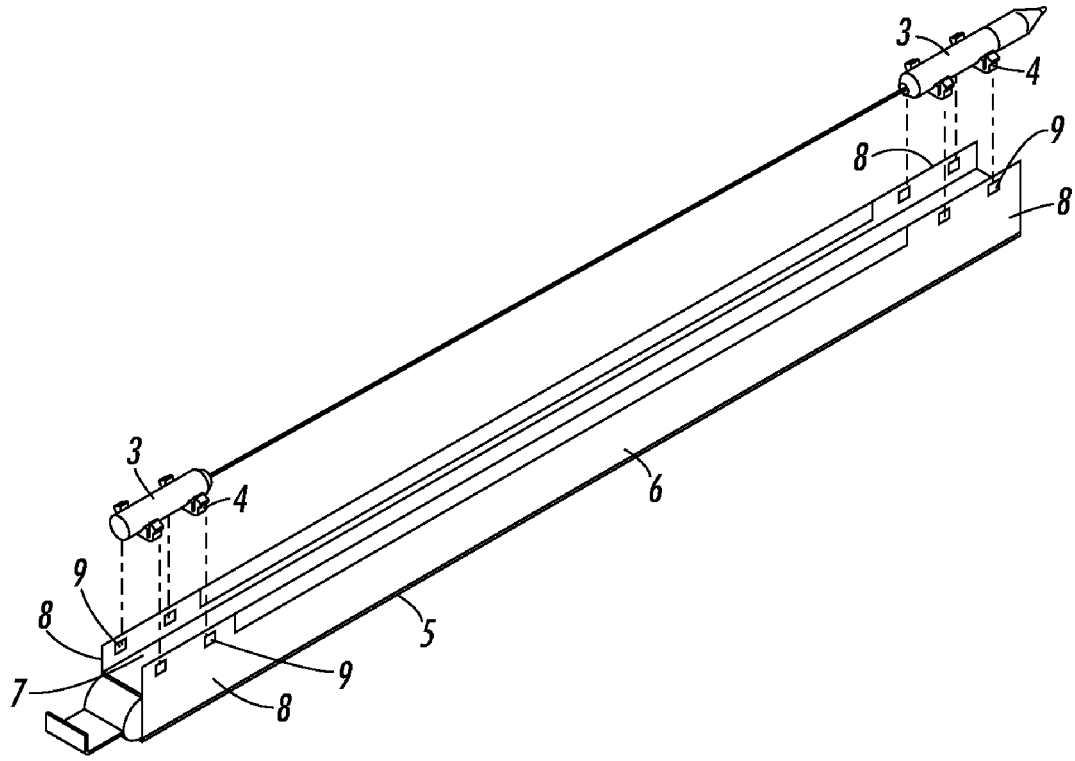
FIG. 2A illustrates in an embodiment an exploded view of a dicorotron housing with the wire assembly after removal.

In FIG. 2A, a typical U-shaped dicorotron unit 6 is illustrated having an open top section 7, a bottom section 5 and side sections 8. Inside sections 8 when containing the wire assembly are located apertures 9 that are operatively positioned immediately adjacent grippers 4 and anchors 3. Grippers 4 can be moved from dicorotron unit 6 so as to dislodge anchors 3 and release entire wire assembly 1. When the wire assembly 1 is determined to be faulty or damaged, the dicorotron unit 6 is turned upside down so that open section 7 faces down when inserted into the removal tool 10 (see FIG. 3.) The wire assembly 1 at that time is movably secured in the dicorotron unit 6, held in place by grippers 4 which are secured to apertures 9. The apertures 9 will align with slots 11 of the removal tool 10 so that pins or projections 12 can pass through both the apertures 9 and slots 11 and dislodge the grippers from apertures 9 (as shown in FIGS. 4A and 4B).

Figure 2B:
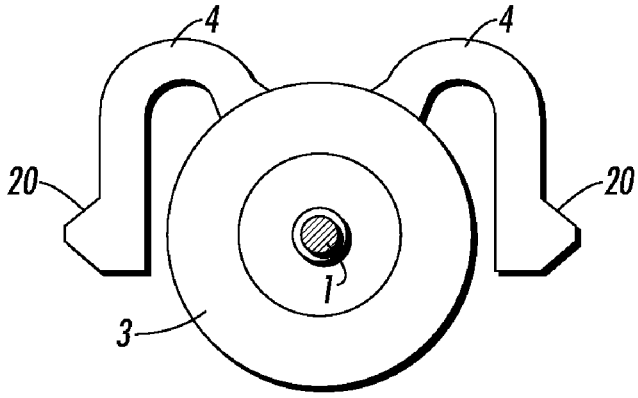
FIG. 2B is an end view of the anchor with attached grippers.

FIG. 2B is an end view illustrating the anchor 3 with the attached grippers 4. Notice that grippers 4 have an angled surface 20 that will receive pin 12 during the wire assembly removal.

Figure 3:
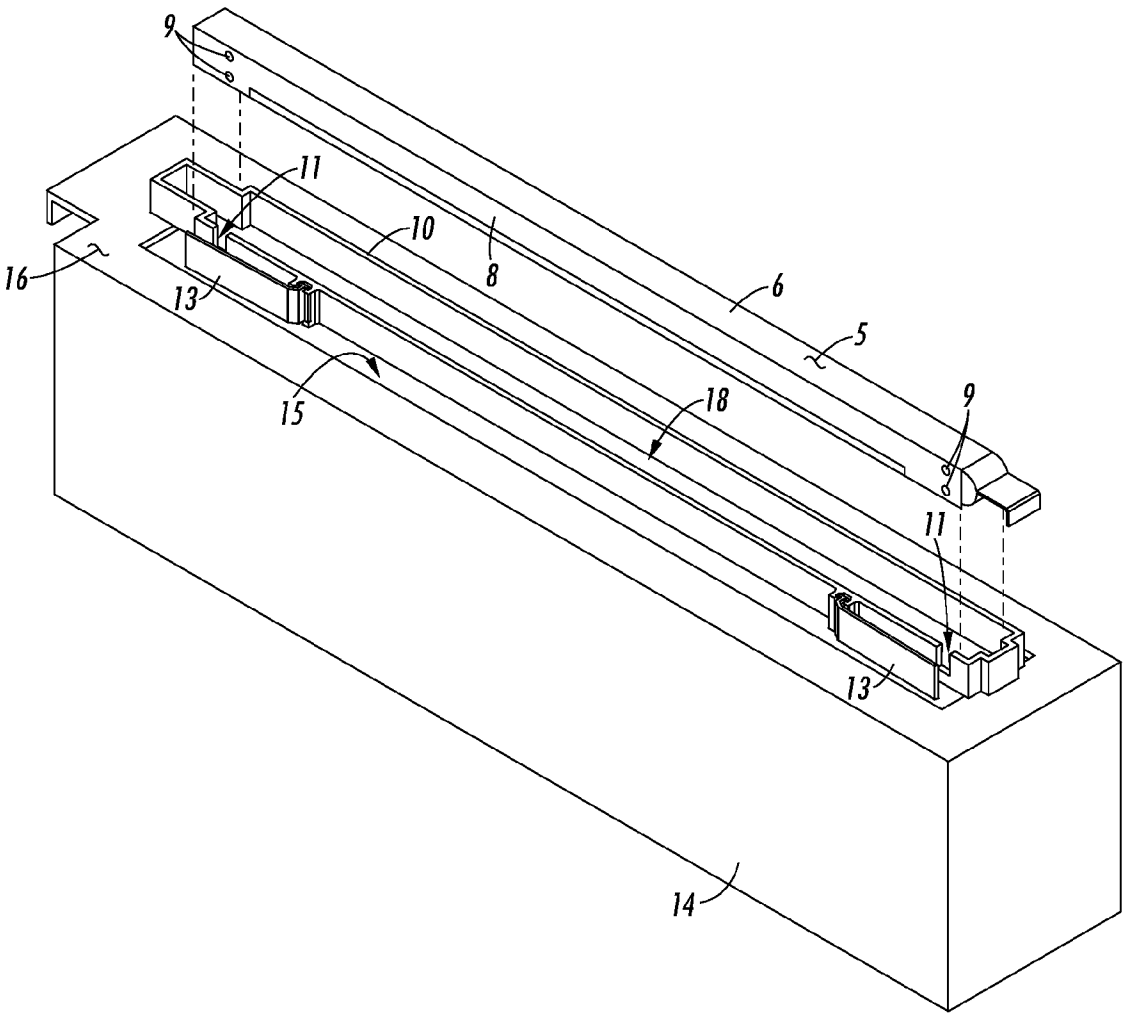
FIG. 3 illustrates in an embodiment the removal system comprising a removal tool mounted on a collection box.

In FIG. 3 an embodiment of the present removal device is shown just prior to the dicorotron unit 6 being placed face down or upside down into the removal tool 10. The dicorotron unit 6 contains the wire assembly 1 which is to be removed. The apertures 9 in the dicorotron housing will align with slots 11 in the removal tool 10 when seated or fitted into the removal tool 10. When flexible levers 13 are pressed inwardly, it will allow projections 12 to pass through both apertures 9 and slots 11 to contact grippers 4 and thereby dislodge grippers 4 and anchors 3. Once anchors 3 are dislodged, the entire wire assembly 1 (see FIG. 1) is removed from the dicorotron unit 6 and falls into box 14 through an opening 15 in the box 14 top section 16. Thus, the old used wire assembly falls into box 14 and is captured therein. In FIG. 3 an opening 15 is shown in box 14 for clarity. Actually, since opening 15 would be directly over tool open bottom portion 17, opening 15 would not be viewable. However, for purposes of clarity, box opening 15 is shown in FIG. 3.

Figure 4A:
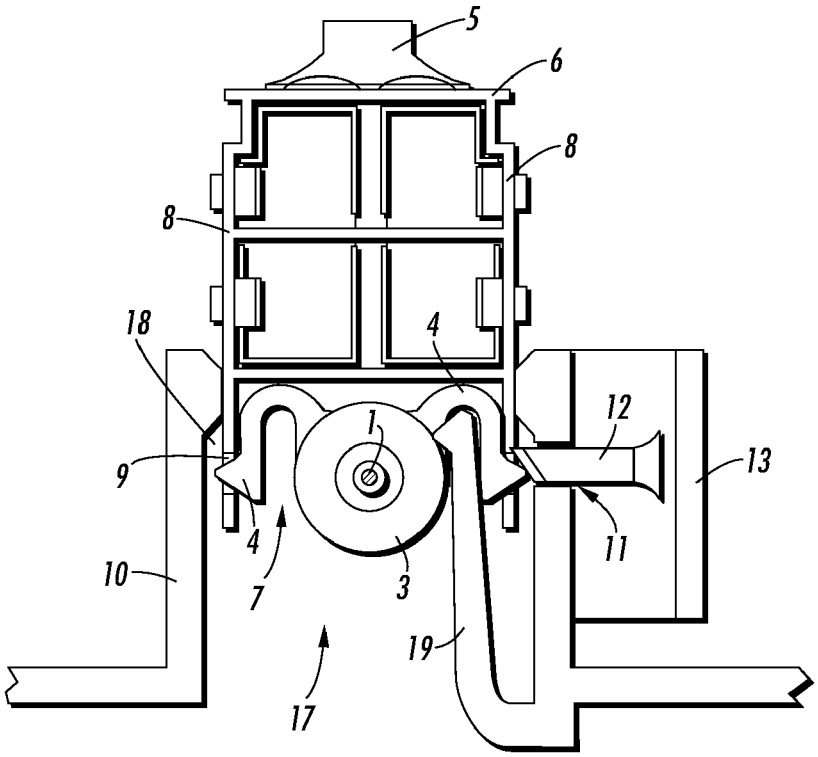
FIGS. 4A and 4B illustrate the system used to remove the old non-functional wire assembly from the dicorotron unit.
Figure 4B:
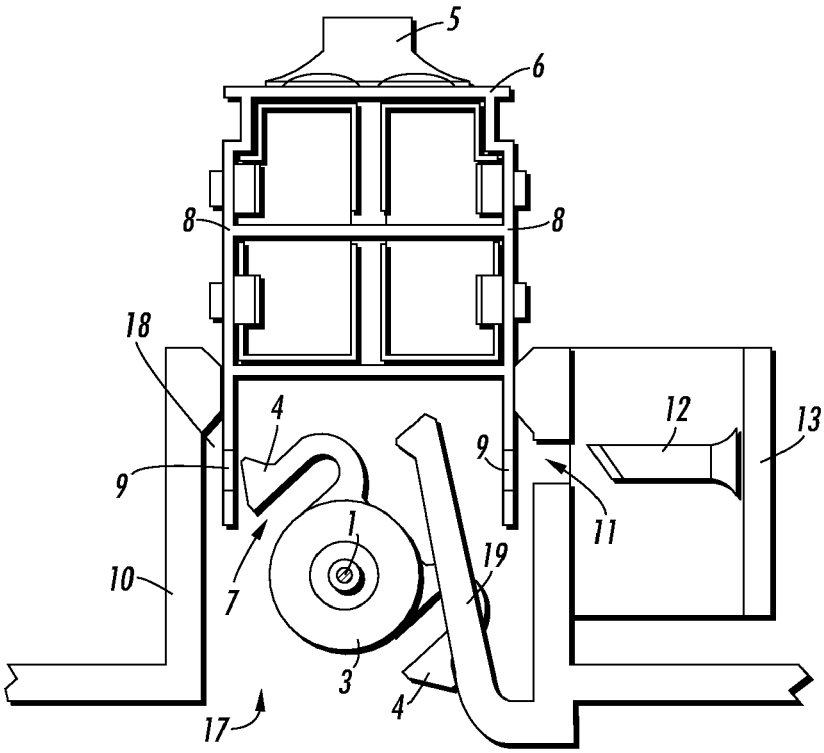

In FIGS. 4A and 4B, a simplified drawing is presented to more clearly explain the working of this embodiment. A wire assembly 1 with anchor(s) 3 is to be dislodged by projection or pin 12. The projection 12 is moved by flexible lever(s) 13 inwardly through slots 11 and apertures 9 to contact the grippers 4 which are inserted into apertures 9 to dislodge anchor(s) 3 and the grippers 4, thereby releasing the entire wire assembly 1 from the dicorotron unit or housing 6. Once anchors 3 are dislodged by projections 12, the entire wire assembly 1 is removed from the dicorotron unit 6 and falls through box opening 15 into box 14 (see FIG. 3). The dicorotron unit 6 is placed upside down into the removal tool 10 so that the bottom portion 5 of the dicorotron unit 6 faces upward and the open top section 7 of the dicorotron unit 6 faces downward and fits or nests into removal tool 10.

In FIG. 4A when the dicorotron 6 is inserted into the top 18 of the opening of the removal tool 10, the release arm 19 is deflected by the anchor 4 in such a way that the release arm 19 is now exerting an opposing force onto the anchor 4. The opposing force is a preload on the anchor 3 to help initiate its release and is applied in a direction that will cause a downward rotation of the anchor 3 once the anchor 3 is released. To release the anchor 3, the release pin 12 is pressed, which in turn exerts a force on the grippers 4, particularly on the angled surface of the gripper 4. This moves the grippers 4 inward and initiates a downward rotation of the anchor 3 once the tip of the gripper 4 is clear of the aperture 9 in the housing.

In FIG. 4B, the anchors 3 and grippers 4 are shown, as grippers 4 are dislodged from apertures 9. The wire assembly 1 then falls through the open bottom 17 of the removal tool 10 through the box opening 15 and into box 14. The open top section 7 of the U-shaped dicorotron unit 6 fits into the open top 18 of the removal tool 10. In FIG. 4B the anchor 3 begins to rotate downward once the tip of the gripper 4 is clear of the aperture 9 in the housing. The release pin or projection 12 is retracted and the release arm 19 further assists in rotating the anchor 3 downwards. Once the grippers 4 on the opposite side of the released grippers are clear of the corresponding apertures 9 on the opposite side of the housing, the wire assembly 1 is free to fall through the opening 17 in the bottom portion of the removal tool.

Figure 5:
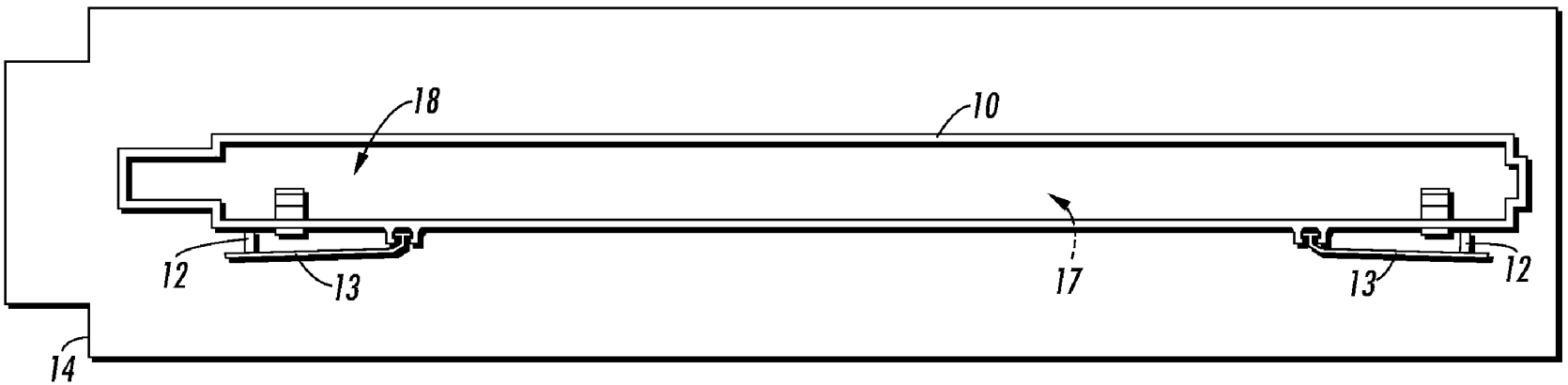
FIG. 5 illustrates a top plan view of an embodiment of the removal tool of this invention.

In FIG. 5, a top view of an embodiment of the removal device of FIG. 3 is shown. In FIG. 5, the removal tool 10 has an open top portion 18 and an open bottom portion 17 (see FIGS. 4A and 4B). The open portion 18 receives the dicorotron unit 6, flexible levers 13 are pushed inwardly so projections 12 dislodge anchors 3 as shown in FIGS. 4A and 4B and discussed above in the description of FIGS. 4A and 4B. The faulty, dislodged wire assembly 1 then falls through the open bottom portion 17 of removal tool 10, then through box opening 15 (see FIG. 3) into storage box 14.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A tool to remove old non-usable wire assemblies from dicorotron units which comprises in an operative relationship a collection box and tool, the tool comprising:

flexible levers at each end portions of the tool adapted to remove said wire assembly from said dicorotron unit;

wherein the tool is located and fixed on a top portion of the box and positioned above an opening in the box, wherein the tool has a configuration conforming generally to a shape of the dicorotron unit but having dimensions at least larger than corresponding dimensions of the dicorotron unit to allow for the dicorotron unit to fit and nest therein, wherein said levers have projections enabled to pass through both a slot in a side portion of said removal tool and an aperture in said dicorotron unit, said aperture being adjacent anchors that hold said wire assembly in place in said dicorotron unit.

2. The tool of claim 1 wherein said levers have projections enabled to contact and dislodge said wire assembly from said dicorotron unit.

3. The tool of claim 1 wherein said removal tool has an open top section enabled to receive and contain said dicorotron unit during a wire assembly removal process.

4. The tool of claim 1 wherein said opening in said box has dimensions at least large enough to permit a removed wire assembly to pass therethrough.

5. The tool of claim 1 wherein said removal tool has an open top portion and an open bottom portion, said open top portion adapted to receive and hold said dicorotron unit and said open bottom portion adapted to allow said wire assembly to pass therethrough to said opening in said box.

6. A tool to remove a previously used wire assembly from a dicorotron unit with a storage box having an opening large enough to permit a released wire assembly to pass therethrough, the tool comprising:

a removal tool having a shape with side sections, end sections, a top portion and a bottom portion, the top portion and the bottom portion being open to receive the dicoroton unit, at least one of the side sections having flexible levers with adjacent slots; and levers having projections that will pass through the slots when the levers are pushed-activated, the slots in operative alignment with apertures in the dicorotron unit;

wherein the apertures are adjacent to anchors in the dicorotron unit, the anchors removably holding the wire assembly in place, the projections enabled to contact and dislodge the anchors during a wire assembly removal operation.

7. The tool of claim 6 wherein said removal tool has dimensions conforming generally to a shape of said dicorotron unit but with dimensions large enough to permit said dicorotron to fit and nest therein.

8. The tool of claim 6 wherein said open top portion is adapted to receive and hold said dicorotron unit during a wire assembly removal operation and wherein said projections, slots, apertures and anchors are all in operative alignment.

9. The tool of claim 6 wherein said removal tool and said storage box are reusable up to a point where said storage box has reached its capacity to accept removed wire assemblies.

10. The tool of claim 6 wherein said removal tool is enabled to release an emptied dicorotron unit after said wire assembly is removed therefrom.

11. A tool to remove old non-usable wire assemblies from dicorotron units which comprises in an operative relationship a collection box and a removal tool, the tool comprising:

a removal tool located and fixed on a top portion of said collection box and positioned above an opening in said collection box, wherein said removal tool having a configuration conforming generally to a shape of said dicorotron unit but having dimensions at least larger than corresponding dimensions of said dicorotron unit to allow for said dicorotron unit to fit and nest therein, flexible levers and slots on each end portions of the removal tool adapted to align with apertures and anchors holding said wire assembly in place;

wherein said slots being in alignment with projections in said flexible levers, said flexible levers adapted when pushed to move said projections through said slots and apertures to contact and dislodge said anchors to release said wire assembly from said dicorotron unit.

12. The tool of claim 11 wherein said tool has an open top section enabled to receive and contain said dicorotron unit during a wire assembly removal process.

* * * * *